US005893345A

United States Patent [19]

Sugimoto et al.

[11] Patent Number: 5,893,345

[45] Date of Patent: Apr. 13, 1999

[54] VALVE CONTROL APPARATUS FOR AN INTERNAL COMBUSTION ENGINE

[75] Inventors: Kiyoshi Sugimoto, Okazaki; Yoshihito Moriya, Nagoya; Tadao Hasegawa, Toyota, all of Japan

[73] Assignee: Toyota Jidosha Kabushiki Kaisha, Toyota, Japan

[21] Appl. No.: 09/069,984

[22] Filed: Apr. 30, 1998

[30] Foreign Application Priority Data

May 15, 1997 [JP] Japan ..... 9-125723

[51] Int. Cl.[6] ..... F01L 1/344; F01L 13/00

[52] U.S. Cl. ..... 123/90.17; 123/90.18; 123/90.31; 123/90.15

[58] Field of Search ..... 123/90.15, 90.16, 123/90.17, 90.18, 90.31; 74/568 R; 464/1, 2, 160

[56] References Cited

U.S. PATENT DOCUMENTS

| | | | |
|---|---|---|---|
| 4,399,784 | 8/1983 | Foley | 123/90.18 |
| 5,080,055 | 1/1992 | Komatsu et al. | 123/90.17 |
| 5,129,407 | 7/1992 | Phillips | 123/90.18 |
| 5,367,991 | 11/1994 | Asai et al. | 123/90.18 |
| 5,381,764 | 1/1995 | Fukuma et al. | 123/90.18 |

FOREIGN PATENT DOCUMENTS

| | | |
|---|---|---|
| 0 108 238 | 5/1984 | European Pat. Off. . |
| A-55-87833 | 7/1980 | Japan . |
| A-7-139327 | 5/1995 | Japan . |

*Primary Examiner*—Weilun Lo

*Attorney, Agent, or Firm*—Oliff & Berridge, PLC

[57] ABSTRACT

A valve characteristic control apparatus is provided with a simple structure in which a cam shaft having three-dimensional cams is axially displaced and the cam shaft is rotated with respect to a crank shaft by a ring gear. An axial driving mechanism axially displaces the intake cam shaft and thereby changes working angles of the three-dimensional cams. In this case, engagement of a spline formed on the cam shaft with teeth formed on an inner peripheral surface of the ring gear allows the cam shaft to axially move with respect to a pulley integrated with the crank shaft. A rotational driving mechanism axially displaces the ring gear, so that a helical spline formed on the pulley engages teeth formed on an outer peripheral surface of the ring gear and a spline formed on the cam shaft engages teeth formed on the inner peripheral surface of the ring gear. Thus, the cam shaft rotates relative to the pulley.

9 Claims, 8 Drawing Sheets

VALVE CONTROL APPARATUS FOR AN INTERNAL COMBUSTION ENGINE

INCORPORATION BY REFERENCE

The disclosure of Japanese Patent Application No. HEI 9-125723 filed on May 15, 1997 including the specification, drawings and abstract is incorporated herein by reference in its entirety.

BACKGROUND OF THE INVENTION

1. Field of the Invention

The present invention relates to a valve characteristic control apparatus for an internal combustion engine which controls valve characteristics such as valve timing (timing and phase for opening and closing a valve), valve opening time period (cam working angle), valve lift amount and the like.

2. Description of the Related Art

In order to achieve the optimal valve characteristic in accordance with the operating conditions of a vehicle engine, various mechanisms capable of changing the characteristics of a valve train have recently been developed and put to practical use. The valve characteristics include valve timing, valve opening time period, valve lift amount and the like. In order to change at least one of the aforementioned valve characteristics, there has been devised a valve train for changing rotational phase of a cam shaft relative to a crank shaft consecutively or in two steps (ON/OFF control), a valve train selectively using a plurality of cams having different profiles, a valve train for axially displacing a cam shaft having three-dimensional cams (solid cams) whose profile changes in the axial direction of the cam shaft, and the like. In an internal combustion engine equipped with a valve characteristic control apparatus as described above, the valve characteristic control is performed in accordance with the operating conditions of the engine in the light of intake efficiency and exhaust gas recirculation. A sufficient intake efficiency contributes to enhancement of engine power, and the exhaust gas recirculation brings about an improvement in the capacity for purging emission substances based on a reduction in $NO_x$ and an improvement in fuel consumption based on a reduction in pumping loss.

For example, Japanese Patent Application No. SHOU 55-87833 discloses a valve characteristic control apparatus for axially displacing a cam shaft having three-dimensional cams, which make it possible to change valve opening time period (cam working angle), valve lift amount and the like. Japanese Patent Application No. HEI 7-139327 discloses a valve characteristic control apparatus for consecutively changing valve timing by shifting a rotational phase of a cam shaft relative to a timing pulley. In this apparatus, the timing pulley is rotatably driven by a timing belt to which rotation of a crank shaft is transmitted. The timing pulley is connected via a ring gear to a cam shaft for driving valves. Formed on inner and outer peripheral surfaces of the ring gear are helical splines (longitudinally extending twisted grooves). A movable piston integrated with the ring gear is hydraulically driven to be displaced in the axial direction so that the cam shaft rotates relative to the timing pulley.

By combining the variable valve train employing three-dimensional cams with the variable valve train employing a ring gear, the valve characteristics including valve timing, valve lift amount and cam working angle can be controlled with a degree of freedom higher than in the conventional art. However, the apparatus with such a combination is bulky, complicated in structure and thus unsuitable for practical use.

SUMMARY OF THE INVENTION

In consideration of the aforementioned circumstances, the present invention provides a valve characteristic control apparatus with a simple structure capable of axially displacing a cam shaft having three-dimensional cams and rotating the cam shaft relative to a crank shaft by means of a ring gear so that a wide range of valve characteristics can be changed.

In order to achieve the aforementioned object, a first embodiment of the present invention provides a valve characteristic control apparatus for an internal combustion engine including a cam shaft, a first actuator, a rotating body, a ring gear and a second actuator. The cam shaft has a spline and a three-dimensional cam whose profile varies in the axial direction of the cam shaft. The first actuator axially displaces the cam shaft. The rotating body has a spline formed on an inner peripheral surface thereof and rotates integrally with a crank shaft. The ring gear has splines formed on inner and outer peripheral surfaces thereof. One of the spline formed on the inner peripheral surface of the ring gear and the spline formed on the outer peripheral surface of the ring gear engaging the spline formed on the cam shaft in a first engagement state, and another of the spline formed on the inner peripheral surface of the ring gear and the outer peripheral surface of the ring gear engaging the spline formed on the rotating body in a second engagement state. The second actuator displaces the ring gear in the axial direction of the cam shaft. One of the engagement states allows axial movement and enables relative rotation in accordance with the axial movement, while the other of the engagement states allows only axial movement.

Further, the valve characteristic control apparatus according to the first embodiment of the present invention may be modified such that the spline formed on the rotating body extends diagonally with respect to the axial direction of the cam shaft.

Still further, a second embodiment of the present invention provides a valve characteristic control apparatus for an internal combustion engine including a cam shaft, a first actuator, a rotating body, a ring gear and a second actuator. The cam shaft has a spline extending in the axial direction of the cam shaft and three-dimensional cams whose profile varies in the axial direction of the cam shaft. The first actuator axially displaces the cam shaft. The rotating body has a spline formed on an inner peripheral surface thereof and rotates integrally with a crank shaft. The spline extends diagonally with respect to the axial direction. The ring gear has splines formed on inner and outer peripheral surfaces thereof. The spline formed on the inner peripheral surface of the ring gear engages the spline formed on the cam shaft, and the spline formed on the outer peripheral surface of the ring gear engages the spline formed on the rotating body. The second actuator displaces the ring gear in the axial direction of the cam shaft.

In the valve characteristic control apparatus constructed according to the first and second embodiments of the present invention, the cam shaft may be driven by the first actuator to be displaced in the axial direction so that working angles of the three-dimensional cams are changed. In this case, the engagement of the cam shaft with the inner peripheral surface of the ring gear allows axial displacement of the cam shaft with respect to the rotating body. The ring gear is driven by the second actuator to be displaced in the axial direction. The engagement of the rotating body with the outer peripheral surface of the ring gear and the engagement of the cam shaft with the inner peripheral surface of the ring gear allow the cam shaft to rotate relative to the rotating body. Thus, the engagement of the cam shaft with the inner peripheral surface of the ring gear and the engagement of the rotating body with the outer peripheral surface of the ring gear allow the cam shaft to move in two different manners. That is, the cam shaft is axially displaced with respect to the rotating body and caused to rotate relative to the rotating body. Therefore, the valve characteristic control apparatus is simplified in structure and reduced in size. The valve characteristic control apparatus of the present invention makes it possible to change a wide range of valve characteristics with a high degree of freedom.

In addition, the valve characteristic control apparatuses according to the first embodiment and the second embodiment make it possible to control rotation of the cam shaft relative to the rotating body and axial displacement of the cam shaft with respect to the rotating body independently of each other. Hence, valve characteristic control can be performed with a high degree of freedom.

BRIEF DESCRIPTION OF THE DRAWINGS

Further objects, features and advantages of the present invention will become apparent from the following description of preferred embodiments with reference to the accompanying drawings, wherein.

DETAILED DESCRIPTION OF PREFERRED EMBODIMENTS

Preferred embodiments of the present invention will now be described with reference to the accompanying drawings.

Figure 1:
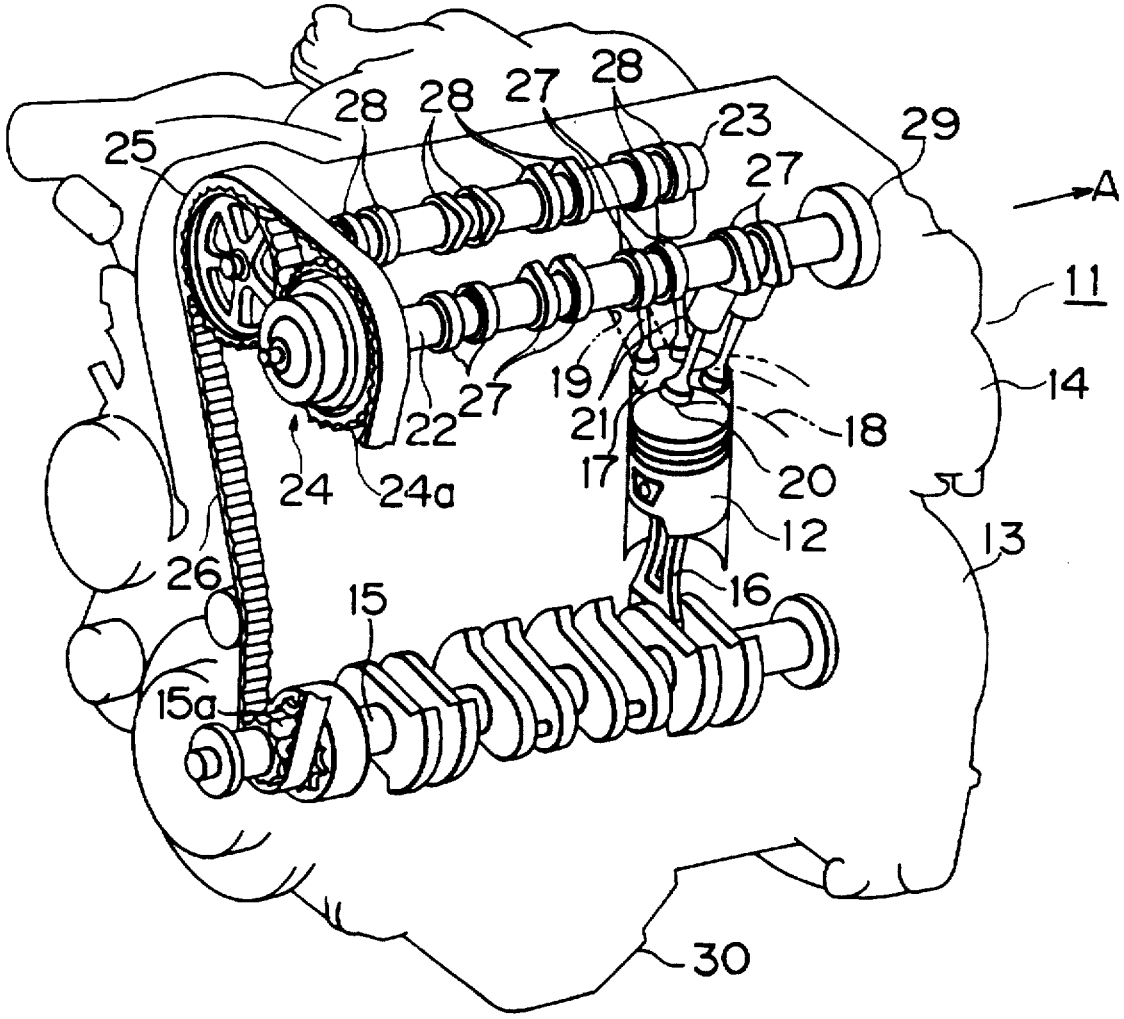
FIG. 1 is a perspective view schematically illustrating an internal combustion engine equipped with a valve characteristic control apparatus according to one embodiment of the present invention.

FIG. 1 is a perspective view schematically illustrating an internal combustion engine equipped with a valve characteristic control apparatus according to one embodiment of the present invention. A four-cycle engine 11, equipped with, for example, four cylinders connected in series, is, for example, a gasoline engine mounted on a vehicle. As illustrated in FIG. 1, the engine 11 is composed of a cylinder block 13 in which a reciprocating piston 12 is accommodated and a cylinder head 14 disposed on the cylinder block 13. An oil pan 30 is disposed under the cylinder block 13.

In a lower portion of the engine 11, a crank shaft 15 serving as an output shaft is rotatably supported. The piston 12 is connected with the crank shaft 15 via a connecting rod 16. Reciprocating movement of the piston 12 is translated by the connecting rod 16 into rotation of the crank shaft 15. Between the cylinder block 13 and the cylinder head 14, there is formed a combustion chamber 17 over the piston 12. An intake passage 18 and an exhaust passage 19 are connected with the combustion chamber 17. The intake passage 18 and the combustion chamber 17 are brought into or out of communication by an intake valve 20, and the exhaust passage 19 and the combustion chamber 17 are brought into or out of communication by an exhaust valve 21.

In the cylinder head 14, an intake cam shaft 22 and an exhaust cam shaft 23 are disposed in parallel with each other. The intake cam shaft 22 is rotatable and axially movable, and the exhaust cam shaft 23 is rotatable. A rotational driving mechanism 24 equipped with a pulley **24*a* is disposed at one end portion of the intake cam shaft 22. An axial driving mechanism 29 for axially displacing the intake cam shaft 22 is disposed at the other end portion of the intake cam shaft 22. A pulley 25 is attached to one end portion of the exhaust cam shaft 23. The pulley 25 and the pulley 24*a* of the rotational driving mechanism 24 are connected via a timing belt 26 with a pulley 15*a* attached to the crank shaft 15. Rotation of the crank shaft 15 is transmitted to the intake cam shaft 22 and the exhaust cam shaft 23 via the timing belt 26, so that the intake cam shaft 22 and the exhaust cam shaft 23** rotate.

The intake cam shaft 22 is provided with intake cams 27 each abutting an upper end of the intake valve 20. The exhaust cam shaft 23 is provided with exhaust cams 28 each abutting an upper end of the exhaust valve 21. When the intake cam shaft 22 and the exhaust cam shaft 23 rotate, the intake valve 20 and the exhaust valve 21 are driven to be opened or closed by the intake cam 27 and the exhaust cam 28 respectively.

Although the exhaust cam 28 has a cam profile remaining unchanged in the axial direction of the exhaust cam shaft 23, the intake cam 27 has a cam profile consecutively varying in the axial direction of the intake cam shaft 22. As the intake cam shaft moves as indicated by an arrow A, the open time period of the intake valve 20 gradually becomes longer and the valve lift amount thereof gradually increases. As the intake cam shaft 22 moves in the opposite direction, the open time period of the intake valve 20 gradually becomes shorter and the valve lift amount thereof gradually decreases. In other words, by axially displacing the intake cam shaft 22, it is possible to adjust the open time period of the intake valve 20 as well as the valve lift amount thereof.

The axial driving mechanism 29 for axially displacing the intake cam shaft 22 and an oil supply structure for hydraulically driving the axial driving mechanism 29 will now be described in detail based on FIG. 2.

Figure 2:
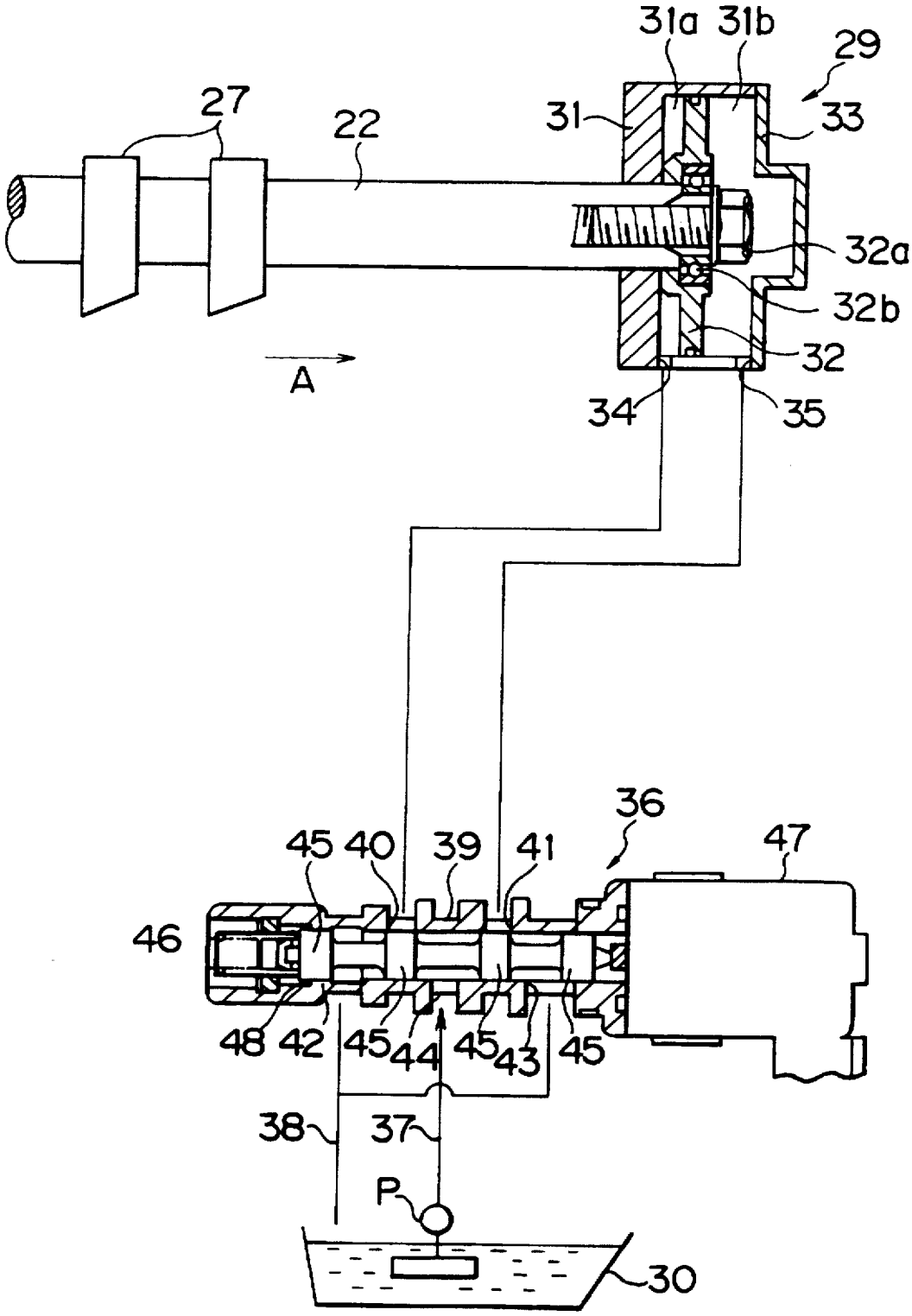
FIG. 2 is a sectional view illustrating an axial driving mechanism and an oil control valve structure for controlling the axial driving mechanism.

As can be seen from FIG. 2, the axial driving mechanism 29 is composed of a cylinder tube 31 with a closed base portion, a piston 32 disposed inside the cylinder tube 31 and an end cover 33 closing an opening portion of the cylinder tube 31. The intake cam shaft 22, which penetrates the base portion of the cylinder tube 31, is connected with the piston 32 via a bolt **32*a*. Rotation of the intake cam shaft 22 is damped by a bearing 32*b*. The cylinder tube 31 is divided into a first pressure chamber 31*a* and a second pressure chamber 31*b*. Formed in the cylinder tube 31 are a first conveyance passage 34 and a second conveyance passage 35, which communicate with the first pressure chamber 31*a* and the second pressure chamber 31*b*** respectively.

When oil is supplied to the first and second pressure chambers 31*a*, 31*b* through the first and second conveyance passages 34, 35, respectively, the piston 32 moves in the axial direction of the intake cam shaft 22. This movement of the piston 32 axially displaces the intake cam shaft 22.

The first and second conveyance passages 34, 35 communicate with a first oil control valve (OCV) 36. A supply passage 37 and a drain passage 38 are connected with the first OCV 36. The supply passage 37 communicates with the oil pan 30 via an oil pump P driven in accordance with rotation of the crankshaft 15. The drain passage 38 directly communicates with the oil pan 30.

The first OCV 36 is provided with a casing 39 which has first and second conveyance ports 40, 41, first and second drain ports 42, 43 and a supply port 44. The first and second conveyance passages 34, 35 are connected with the first and second conveyance ports 40, 41, respectively. In addition, the supply passage 37 is connected with the supply port 44, and the drain passage 38 is connected with the first and second drain ports 42, 43. A spool 48 having four valve portions 45 is disposed within the casing 39. The spool 48 is driven in one direction by a coil spring 46 and in the other direction by an electromagnetic solenoid 47.

When the electromagnetic solenoid 47 is demagnetized, the coil spring 46 applies an elastic force to the spool 48 to position the spool 48 on one end side of the casing 39 (on the right side in FIG. 2). Thus, the first conveyance port 40 communicates with the first drain port 42 and the second conveyance port 41 communicates with the supply port 44. In this state, oil in the oil pan 30 is supplied to the second pressure chamber 31*b* via the first OCV 36 and the second conveyance passage 35. Oil in the first pressure chamber 31a is brought back to the oil pan 30 via the first conveyance passage 34, the first OCV 36 and the drain passage 38. As a result, the piston 32 and the intake cam shaft 22 move in a direction opposite to the direction indicated by the arrow A.

On the other hand, when the electromagnetic solenoid 47 is excited, the electromagnetic solenoid acts on the spool 48 against the elastic force of the coil spring 46 to position the spool 48 on the other end side of the casing 39 (on the left side in FIG. 2). Thus, the second conveyance port 41 communicates with the second drain port 43 and the first conveyance port 40 communicates with the supply port 44. In this state, oil in the oil pan 30 is supplied to the first pressure chamber 31*a* via the first OCV 36 and the first conveyance passage 34. Oil in the second pressure chamber 31*b* is brought back to the oil pan 30 via the second conveyance passage 35, the first OCV 36 and the drain passage 38. As a result, the piston 32 and the intake cam shaft 22 move in the direction indicated by the arrow A.

Further, when supply of electricity to the electromagnetic solenoid 47 is controlled such that the spool 48 is centered within the casing 39, the first and second conveyance ports 40, 41 are closed. Thus, oil is not allowed to flow through the first and second conveyance ports 40, 41. In this state, oil is not supplied to or drained from the first and second pressure chambers 31*a*, 31*b*. That is, oil is confined within the first and second pressure chambers 31*a*, 31*b*. Thus, the piston 32 and the intake cam shaft 22 cannot move in the axial direction.

The rotational driving mechanism 24 for adjusting timings for opening and closing the intake valve 20 will now be described based on FIG. 3. As can be seen from FIG. 3, the intake cam shaft 22, to which the rotational driving mechanism 24 is attached, is supported by a bearing portion 14*a* of the cylinder head 14. The rotational driving mechanism 24 is equipped with the pulley 24*a*, which is composed of a tube portion 51 through which the intake cam shaft 22 is passed, a disc plate portion 52 protruding from an outer peripheral surface of the tube portion 51, and a plurality of outer teeth 53 disposed on the outer peripheral surface of the disc plate portion 52. The aforementioned timing belt 26 is hung on the outer teeth 53 of the pulley 24*a*.

The cover 54 covering the end portion of the intake cam shaft 22 is fixed to the pulley 24*a* by means of a bolt 55 and a pin 56. A plurality of inner teeth 57 forming a helical spline are disposed on an inner peripheral surface of the cover 54 at a location corresponding to the end portion of the intake cam shaft 22. In the case where two members are connected with each other, the helical spline indicates either a groove of a predetermined length formed in one member or a convex portion formed in another member and engaging the groove. In this case, the convex portion can move within the groove. On the other hand, an inner cap 60 is fixed to the end portion of the intake cam shaft 22 by means of a hollow bolt 58 and a pin 59. A plurality of outer teeth 61 forming a straight spline are disposed on an outer peripheral surface of the inner cap 60. Each of the outer teeth 61 faces each of the inner teeth 57 formed on the cover 54.

A tubular ring gear 62 is interposed between the respective outer teeth 61 and the respective inner teeth 57 such that the ring gear 62 can rotate in the axial direction of the intake cam shaft 22. A plurality of skew teeth 63 forming a spline engaging the aforementioned inner teeth 57 are disposed on an outer peripheral surface of the ring gear 62. A plurality of flat teeth 64 forming a spline engaging the aforementioned outer teeth 61 are disposed on an inner peripheral surface of the ring gear 62. The flat teeth 64 extend like a straight line in the axial direction of the intake cam shaft 22. The flat teeth 64 formed on the inner peripheral surface of the ring gear 62 engage the outer teeth (the straight spline) 61 formed on the inner cap 60 such that the intake cam shaft 22 can move in the axial direction. As described above, the inner teeth 57 engage the skew teeth 63 and the outer teeth 61 engage the flat teeth 64. In this case, one of the teeth on one side faces a groove portion between two of the teeth on the other side such that the former cannot rotate relative to the latter.

Hence, in the rotational driving mechanism 24, when rotation of the crank shaft 15 caused by a driving power from the engine is transmitted to the pulley 24*a* via the timing belt 26, the pulley 24*a* and the intake cam shaft 22 integrally rotate. As described above, when the intake cam shaft 22 rotates, the intake valve 20 (FIG. 1) is driven to be opened or closed.

When the ring gear 62 moves towards the pulley 24*a* (towards the right side in FIG. 3), the skew teeth 63 formed on the outer peripheral surface of the ring gear 62 engage the inner teeth 57 (the helical spline) formed on the cover 64. Thus, there is generated a change in relative rotational phase between the pulley 24*a* and the intake cam shaft 22, so that the intake cam shaft 22 is shifted towards the retardation side with respect to the crank shaft 15. That is, the timings for opening and closing the intake valve 20 are retarded. On the other hand, when the ring gear 62 moves towards the cover 54 (towards the left side in FIG. 3), the skew teeth 63 formed on the outer peripheral surface of the ring gear 62 engage the inner teeth 57 formed on the cover 54. Thus, there is generated a reverse change in relative rotational phase between the pulley 24*a* and the intake cam shaft 22, so that the intake cam shaft 22 is shifted towards the advancement side with respect to the crank shaft 15. That is, the timings for opening and closing the intake valve 20 are advanced.

A structure for hydraulically controlling displacement of the ring gear 62 in the rotational driving mechanism 24 will now be described. An inner space of the aforementioned cover 54 is divided by the ring gear 62 into a retardation-side hydraulic chamber 65 and an advancement-side hydraulic chamber 66. A retardation control oil passage 67 communicating with the retardation-side hydraulic chamber 65 and an advancement control oil passage 68 communicating with the advancement-side hydraulic chamber 66 extend through the intake cam shaft 22. The retardation control oil passage 67 communicates with the retardation-side hydraulic chamber 65 via an inner space of the hollow bolt 58 and leads to a second oil control valve (OCV) 69 via an inner space of the cylinder head 14. The advancement control oil passage 68 communicates with the advancement-side hydraulic chamber 66 and leads to the second OCV 69 via the inner space of the cylinder head 14.

On the other hand, a supply passage 70 and a drain passage 71 are connected with the second OCV 69. The supply passage 70 leads to the oil pan 30 via the aforementioned oil pump P and the exhaust passage 71 directly leads to the oil pan 30. Thus, the oil pump P delivers oil from the oil pan 30 into the supply passages 37, 70.

The second OCV 69, which is constructed substantially in the same manner as the first OCV 36, is provided with the casing 39, the first and second conveyance ports 40, 41, the first and second drain ports 42, 43, the supply port 44, the coil spring 46, the electromagnetic solenoid 47 and the spool 48. The retardation control oil passage 67 is connected with the first conveyance port 40 and the advancement control oil passage 68 is connected with the second conveyance port 41. The supply passage 70 is connected with the supply port 44 and the drain passage 71 is connected with the first and second drain ports 42, 43.

Figure 3:
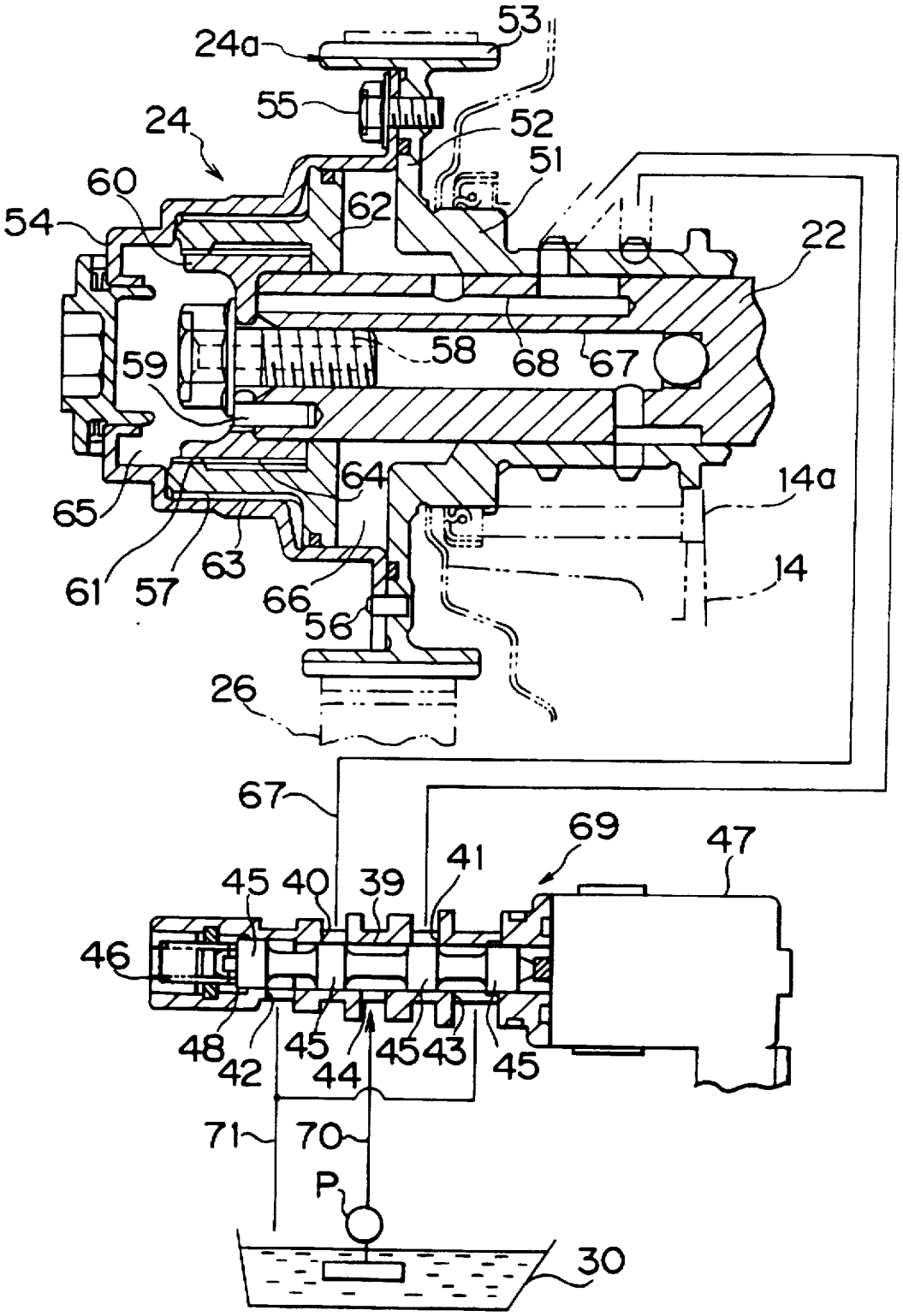
FIG. 3 is a sectional view illustrating a rotational driving mechanism and an oil control valve structure for controlling the rotational driving mechanism.

Hence, when the electromagnetic solenoid 47 is demagnetized, the coil spring 46 applies an elastic force to the spool 48 to position the spool 48 on one end side of the casing 39 (on the right side in FIG. 3). Thus, the first conveyance port 40 communicates with the first drain port 42 and the second conveyance port 41 communicates with the supply port 44. In this state, oil in the oil pan 30 is supplied to the advancement-side hydraulic chamber 66 of the rotational driving mechanism 24 via the supply passage 70, the second OCV 69 and the advancement control oil passage 68. Oil in the retardation-side hydraulic chamber 65 of the rotational driving mechanism 24 is brought back to the oil pan 30 via the retardation control oil passage 67, the second OCV 69 and the drain passage 71. As a result, the ring gear 62 is displaced towards the retardation-side hydraulic chamber 65. As described above, the timings for opening and closing the intake valve 20 are advanced.

On the other hand, when the electromagnetic solenoid 47 is excited, the electromagnetic solenoid acts on the spool 48 against the elastic force of the coil spring 46 to position the spool 48 on the other end side of the casing 39 (on the left side in FIG. 3). Thus, the second conveyance port 41 communicates with the second drain port 43 and the first conveyance port 40 communicates with the supply port 44. In this state, oil in the oil pan 30 is supplied to the retardation-side hydraulic chamber 65 of the rotational driving mechanism 24 via the supply passage 70, the second OCV 69 and the retardation control oil passage 67. Oil in the advancement-side hydraulic chamber 66 of the rotational driving mechanism 24 is brought back to the oil pan 30 via the advancement control oil passage 68, the second OCV 69 and the drain passage 71. As a result, the ring gear 62 is displaced towards the advancement-side hydraulic chamber 66. As described above, the timings for opening and closing the intake valve 20 are retarded.

Further, when supply of electricity to the electromagnetic solenoid 47 is controlled such that the spool 48 is centered within the casing 39, the first and second conveyance ports 40, 41 are closed. Thus, oil is not allowed to flow through the first and second conveyance ports 40, 41. In this state, oil is not supplied to or drained from the retardation-side hydraulic chamber 65 and the advancement-side hydraulic chamber 66. That is, oil is confined within the hydraulic chambers 65, 66 and the ring gear 62 is fixed. Thus, the timings for opening and closing the intake valve 20 depend on a location where the ring gear 62 is fixed.

As described above, the valve characteristic control apparatus of the present invention is equipped with the axial driving mechanism 29 and the rotational driving mechanism 24. Therefore, the rotational angular position (the rotational phase) of the intake cam shaft 22 relative to the pulley **24*a* (the crank shaft 15) and the axial position of the intake cam shaft 22** can be controlled consecutively and completely independently of each other. In other words, the intake valve timing and the intake cam working angle can be controlled consecutively and completely independently of each other. The operation of the valve characteristic control apparatus will hereinafter be described with reference to timing charts which indicate timings for opening and closing the valves using crank angles.

Figure 4:
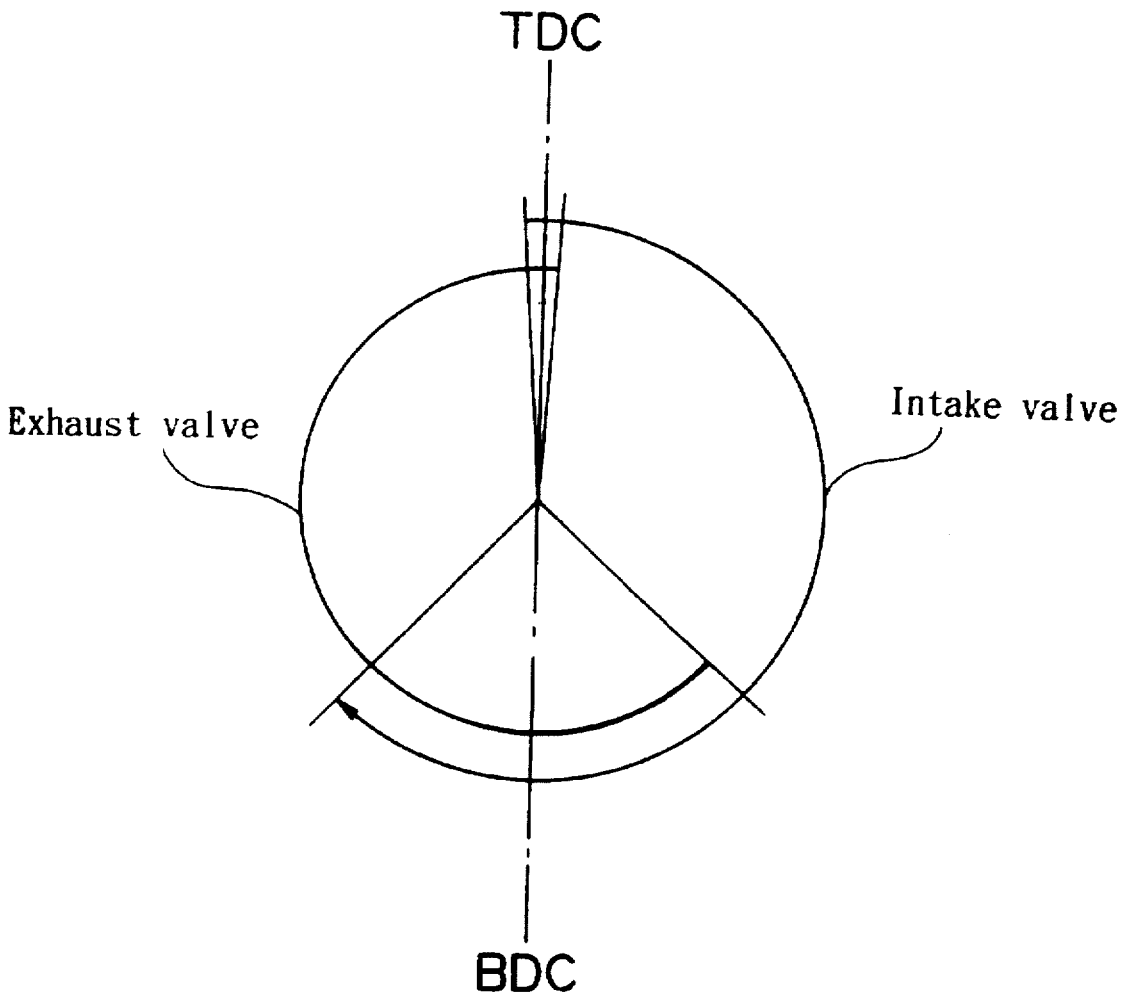
FIG. 4 is a valve timing chart of an engine that is not equipped with a variable valve train.
Figure 5:
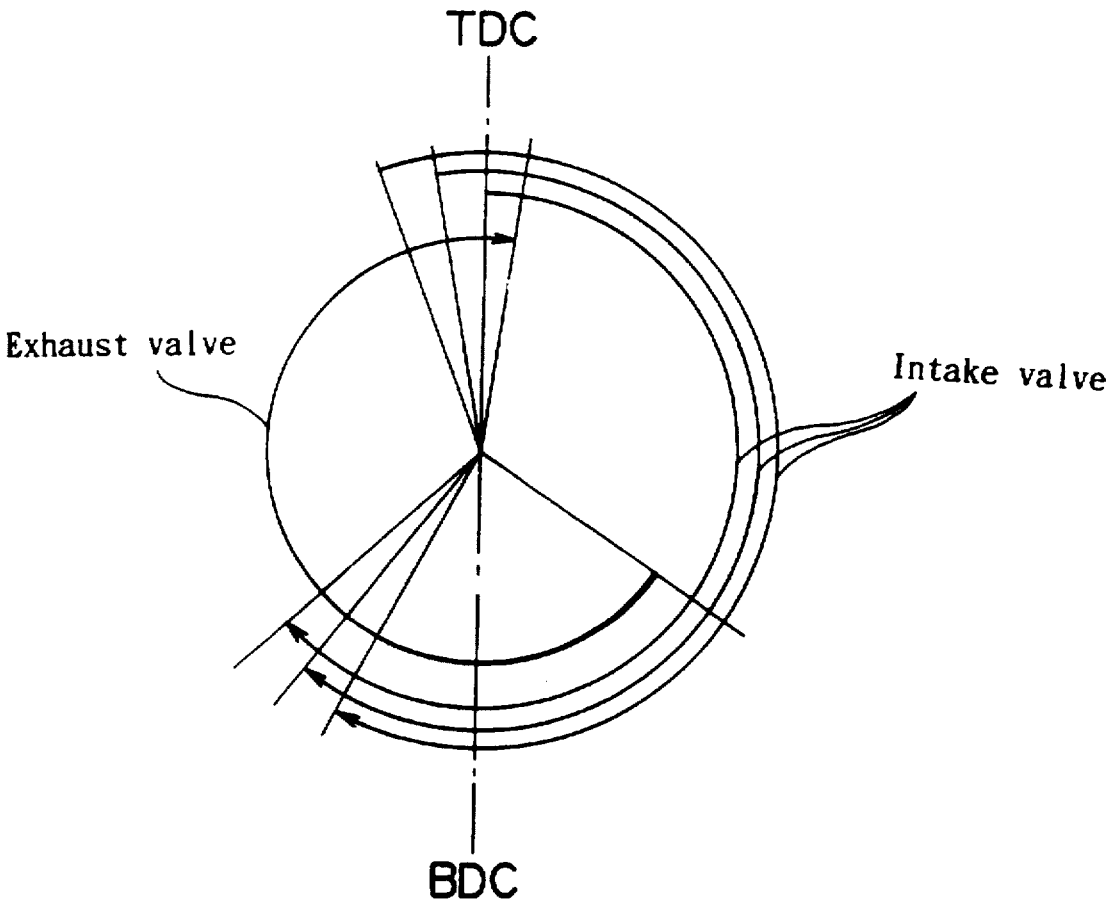
FIG. 5 is a valve timing chart of an engine in which a ring gear allows an intake cam shaft to rotate relative to a crank shaft.
Figure 6:
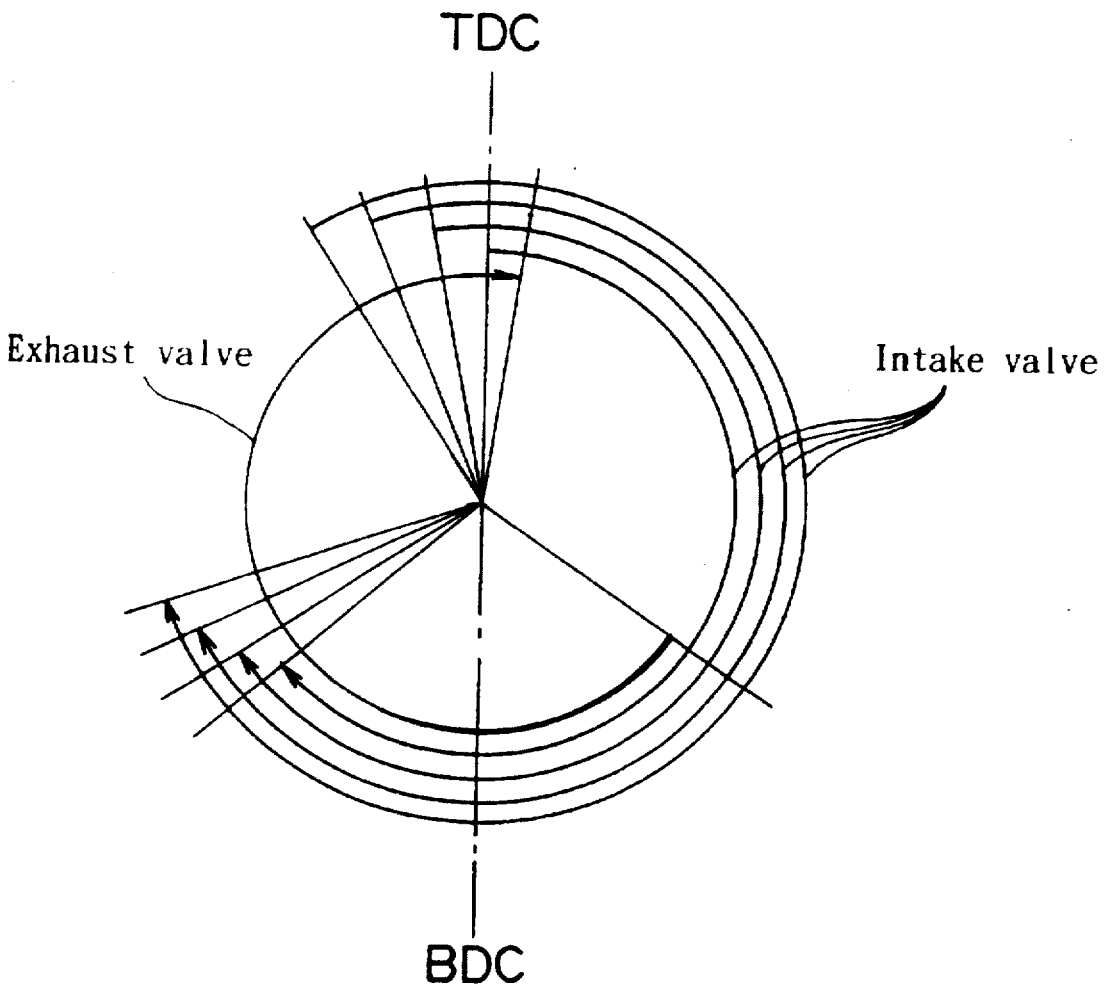
FIG. 6 is a valve timing chart of an engine in which a cam shaft provided with three-dimensional cams axially moves.

A timing chart in FIG. 4 relates to a conventional engine that is not equipped with the axial driving mechanism 29 or the rotational driving mechanism 24. As can be seen from FIG. 4, not only the exhaust valve but also the intake valve is opened or closed at a set timing. A timing chart in FIG. 5 relates to an engine having only the rotational driving mechanism 24. As can be seen from FIG. 5, the intake valve is open for a set time period, but the timings for opening and closing the intake valve can be changed. A timing chart in FIG. 6 relates to an engine having only the axial driving mechanism 29. As can be seen from FIG. 6, the center of the crank angle position corresponding to respective opening time periods of the intake valve is fixed, but the opening time period of the intake valve can be changed.

Figure 7:
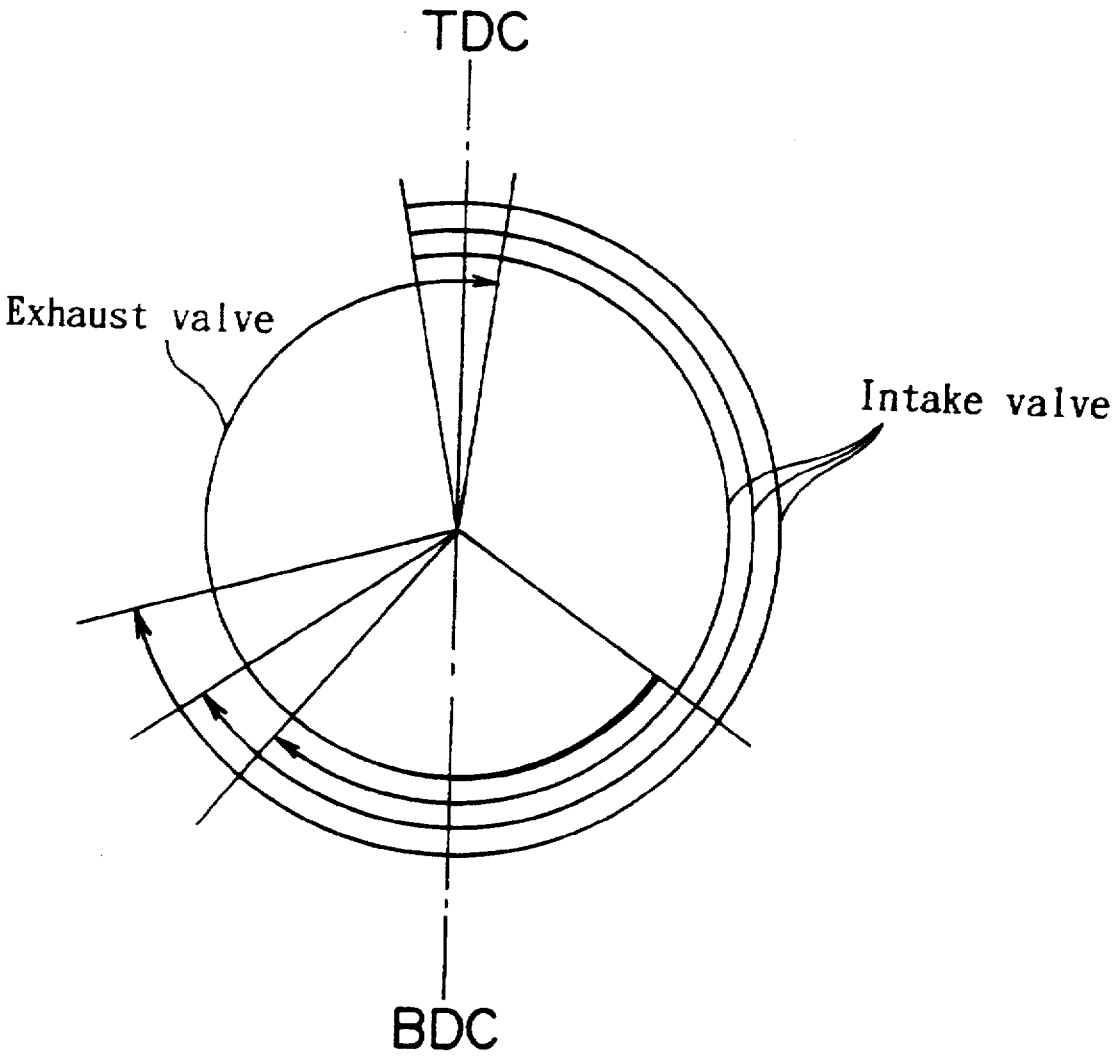
FIG. 7 is a valve timing chart illustrating an example of valve timing control in an engine equipped with the valve characteristic control apparatus according to one embodiment of the present invention.
Figure 8:
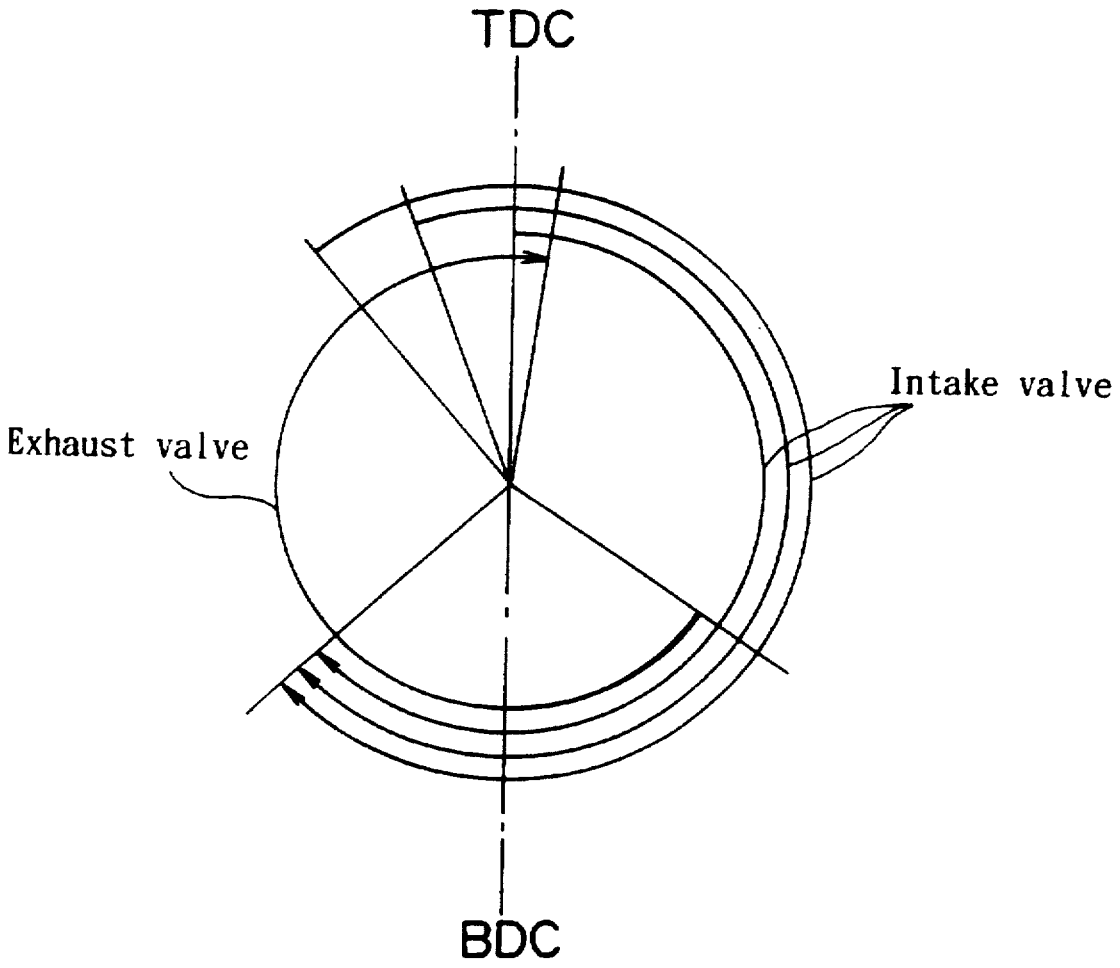
FIG. 8 is a valve timing chart illustrating an example of valve timing control in an engine equipped with the valve characteristic control apparatus according to one embodiment of the present invention.

Timing charts in FIGS. 7 and 8 relate to the engine according to this embodiment, which is equipped with both the rotational driving mechanism 24 and the axial driving mechanism 29 and can control the driving mechanisms 24, 29 independently of each other. As can be seen from FIG. 7, the intake valve can be opened at a set timing and the timing for closing the intake valve can be changed. That is, the valve overlap amount can be fixed. As can be seen from FIG. 8, the intake valve can be closed at a set timing and the timing for opening the intake valve can be changed. That is, the valve overlap amount can be changed.

Thus, the engine 11 according to this embodiment allows the intake cam shaft 22 having three-dimensional cams to axially move and rotate relative to the crank shaft 15. The rotation of the intake cam shaft 22 relative to the crank shaft 15, realized by using the ring gear 62, is independent of the axial movement thereof. Therefore, it is possible to control valve timing, valve lift amount and cam working angle with a high degree of freedom. Besides, the engagement of the outer teeth 61 (the straight spline) of the inner cap 60 with the flat teeth 64 formed on the inner peripheral surface of the ring gear 62 allows the intake cam shaft 22 to axially move with respect to the pulley **24*a* and rotate relative to the pulley 24*a*. Since the engagement of the outer teeth 61 with the flat teeth 64 allows the intake cam shaft 22** to move in two different manners, the valve characteristic control apparatus is simplified in structure and reduced in size.

Although in this embodiment, the cover 54 is attached to the pulley 24*a* by means of the bolt 55 and the pin 56, it is also possible to integrate the pulley with the cover and provide the pulley itself with a spline.

Although in this embodiment, the inner cap 60 is attached to the intake cam shaft 22 by means of the hollow bolt 58 and the pin 59, it is also possible to integrate the inner cap with the intake cam shaft and provide the intake cam shaft itself with a spline.

In this embodiment, the cover 54, the inner cap 60 and the ring gear 62 are provided with a plurality of inner teeth 57, a plurality of outer teeth 61 and a plurality of skew teeth 63 and flat teeth 64, respectively. However, those components may be connected by one convex portion engaging one groove portion.

In other embodiments, the engagement of the outer teeth 61 formed on the inner cap 60 with the flat teeth 64 formed on the inner peripheral surface of the ring gear 62 may be realized by a helical spline. In this case, although phase control and working angle control cannot be performed independently of each other, an angular range for allowing phase shift can advantageously be widened.

In this embodiment, the helical spline constitutes a spline extending diagonally with respect to the axial direction of the cam shaft. However, any spline that allows relative rotation of a member in accordance with an axial movement thereof may constitute the spline extending diagonally with respect to the axial direction of the cam shaft.

Should the exhaust valve characteristic be controlled by providing the exhaust cam shaft 23 with the rotational driving mechanism and the axial driving mechanism, it would be possible to satisfy the demands for further enhancement in the engine performance.

While the present invention has been described with reference to what are presently considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single component of an embodiment, are also within the spirit and scope of the invention.

What is claimed is:

1. A valve characteristic control apparatus for an internal combustion engine having a crankshaft, the valve characteristic control apparatus comprising:

a cam shaft having a spline and a three-dimensional cam, the cam having a profile that varies in an axial direction of the cam shaft;

a first actuator that axially displaces the cam shaft;

a rotating body having a spline and rotating integrally with the crank shaft;

a ring gear having a spline formed on an inner peripheral surface thereof and a spline formed on an outer peripheral surface thereof, one of the spline formed on the inner peripheral surface of the ring gear and the spline formed on the outer peripheral surface of the ring gear engaging the spline formed on the cam shaft in a first engagement state, and another of the spline formed on the inner peripheral surface of the ring gear and the outer peripheral surface of the ring gear engaging the spline formed on the rotating body in a second engagement state; and a second actuator that displaces the ring gear in the axial direction of the cam shaft, wherein one of the first engagement state and the second engagement state allows axial movement of the cam shaft and enables relative rotation between the cam shaft and the crank shaft in accordance with the axial movement, and another of the first engagement state and the second engagement state allows only axial movement of the cam shaft.

2. The valve characteristic control apparatus according to claim 1, wherein at least one of the spline formed on the cam shaft, the spline formed on the rotating body, the spline formed on the inner peripheral surface of the ring gear and the spline formed on the outer peripheral surface of the ring gear extends diagonally with respect to the axial direction of the cam shaft.

3. The valve characteristic control apparatus according to claim 2, wherein the spline formed on the rotating body extends diagonally with respect to the axial direction of the cam shaft.

4. The valve characteristic control apparatus according to claim 3, wherein the spline extending diagonally with respect to the axial direction of the cam shaft is a helical spline.

5. The valve characteristic control apparatus according to claim 2, wherein one of the spline formed on the inner peripheral surface of the ring gear and the spline formed on the outer peripheral surface of the ring gear engages the spline formed on the rotating body and extends diagonally with respect to the axial direction of the cam shaft.

6. The valve characteristic control apparatus according to claim 5, wherein the spline extending diagonally with respect to the axial direction of the cam shaft is a helical spline.

7. The valve characteristic control apparatus according to claim 2, wherein the spline extending diagonally with respect to the axial direction of the cam shaft is a helical spline.

8. A valve characteristic control apparatus for an internal combustion engine having a crankshaft, the valve characteristic control apparatus comprising:

a cam shaft having a straight spline extending in an axial direction of the cam shaft and a three-dimensional cam, the cam having a profile that varies in the axial direction of the cam shaft;

a first actuator that axially displaces the cam shaft;

a rotating body having a spline formed on an inner peripheral surface thereof and rotating integrally with the crank shaft, the spline of the rotating body extending diagonally with respect to the axial direction of the cam shaft;

a ring gear having a spline formed on an inner peripheral surface thereof and a spline formed on an outer peripheral surface thereof, the spline formed on the inner peripheral surface of the ring gear engaging the straight spline formed on the cam shaft and the spline formed on the outer peripheral surface of the ring gear engaging the spline formed on the rotating body; and a second actuator that displaces the ring gear in the axial direction of the cam shaft.

9. The valve characteristic control apparatus according to claim 8, wherein the spline extending diagonally with respect to the axial direction of the cam shaft is a helical spline.

* * * * *